United States Patent [19]

Flanagan et al.

[11] Patent Number: 5,053,087

[45] Date of Patent: Oct. 1, 1991

[54] ULTRA HIGH-ENERGY AZIDE CONTAINING GUN PROPELLANTS

[75] Inventors: Joseph E. Flanagan, Woodland Hills; John C. Gray, Ventura, both of Calif.

[73] Assignee: Rockwell International Corporation, El Segundo, Calif.

[21] Appl. No.: 487,472

[22] Filed: Mar. 2, 1990

[51] Int. Cl.[5] ..... C06B 45/10

[52] U.S. Cl. ..... 149/19.8; 149/35; 149/88; 149/92

[58] Field of Search ..... 149/35, 19.8, 88, 92

[56] References Cited

U.S. PATENT DOCUMENTS

| | | | |
|---|---|---|---|
| 3,932,241 | 1/1976 | Sayles | 149/19.3 |
| 3,950,196 | 4/1976 | Flanagan et al. | 149/92 |
| 4,085,123 | 4/1978 | Flanagan et al. | 260/349 |
| 4,234,363 | 11/1980 | Flanagan | 149/92 |
| 4,288,262 | 9/1981 | Flanagan et al. | 149/92 |
| 4,373,976 | 2/1983 | Flanagan et al. | 149/92 |
| 4,427,466 | 1/1984 | Flanagan et al. | 149/92 |
| 4,761,250 | 8/1988 | Frankel et al. | 260/349 |

*Primary Examiner*—Stephen J. Lechert, Jr.

*Attorney, Agent, or Firm*—H. Fredrick Hamann; Harry B. Field; David C. Faulkner

[57] ABSTRACT

A family of ultra high-energy gun propellant systems based upon a nitrocellulose binder matrix, and containing a variety of azide components to provide a formulation having reduced isochoric flame temperatures and ultra-high mass impetus.

10 Claims, No Drawings

ULTRA HIGH-ENERGY AZIDE CONTAINING GUN PROPELLANTS

BACKGROUND OF THE INVENTION

1. Field of the Invention

This invention relates to propellants and is particularly directed to gun propellant formulations containing energetic azide compounds, to provide reduced isochoric flame temperatures and ultra-high mass impetus.

2. Description of Related Art

Various propellant formulations have evolved over the years in response to the requirements for improved gun propellant compositions which impart high velocity and penetrability to associate projectiles. For modern applications, particularly with respect to high velocity tank guns and defense interceptor systems, mass impetus levels approaching 500,000 ft-$lb_f/lb_m$ or greater are desired. Such ultra-high force propellants have heretofore been dispossessed of the desirable combination of reduced isochoric flame temperatures and ultra-high mass impetus.

Another factor associated with gun propellant compositions is erosivity. Erosivity is approximately proportional to the flame temperature ($T_v$) to the eighth power. The propellant composition JA-2, consisting essentially of 59.5 percent nitrocellulose (13.1N); 14.9 percent nitroglycerin; 24.8 percent diethyleneglycol dinitrate; and the remainder 0.8 percent additives, has a mass impetus of about 385,000 ft-$lb_f/lb_m$ and an isochoric flame temperature of about 3500° K. compared to a cyclotrimethylenetrinitramine (RDX) nitrocellulose-based propellant having a mass impetus of about 466,700 ft-$lb_f/lb_m$ and an isochoric flame temperature of about 4300° K. The RDX system is five and a half times as erosive as the JA-2 system.

The new azide systems of the present invention are about twice as erosive as the known JA-2 system, but they are substantially less erosive than known RDX systems. In addition, the new formulations of the present invention exhibit greater mass impetus and reduced isochoric flame temperatures when compared to known propellant formulations.

BRIEF SUMMARY AND OBJECTS OF THE INVENTION

The aforementioned disadvantages associated with known gun propellants are obviated by the present invention which encompasses a family of candidate propellants having acceptable impetus levels and lowered isochoric flame temperatures.

The advantages of the present invention are realized in propellant formulations utilizing a combination of select azide compounds as high energy constituents thereof.

Accordingly, an object of the present invention is to provide improved propellants.

Another object of the present invention is to provide gun propellants having flame temperatures which are lower than those of advanced military propellants, while yielding comparable or greater mass impetus.

These and other object and features of the present invention will be apparent from the following detailed description.

DETAILED DESCRIPTION OF THE INVENTION

The propellants of the present invention are characterized by the utilization of highly energetic azido compounds which include those selected from 1,5-diazido-3-nitrazapentane (DANPE); 1,6-diazido-2,5-dinitrazahexane (DADNH); 1,7-diazido-2,4,6-trinitrazaheptane (DATH); and 1,9-diazido-2,4,6,8-tetranitrazanonane (DATN). In addition to the aforementioned azide compounds, the propellant formulations of the present invention also contain at least 25% of a nitrocellulose binder system. This binder system, or matrix, comprises in a 1:1:1 ratio, a nitrocellulose polymer and the co-plastisizers DANPE and nitroisobutylglycerol trinitrate (NIBTN).

Propellant compositions having reduced isochoric flame temperatures and high mass impetus, prepared in accordance with the present invention, are set forth below.

TABLE I

| | Weight Percent | | | |
|---|---|---|---|---|
| | Binder* | DADNH | DATH | DATN |
| F-1 | 25.0 | 40.0 | 35.0 | — |
| F-2 | 25.0 | 50.0 | 25.0 | — |
| F-3 | 25.0 | 60.0 | 15.0 | — |
| F-4 | 25.0 | 40.0 | — | 35.0 |
| F-5 | 25.0 | 50.0 | — | 25.0 |
| F-6 | 25.0 | 60.0 | — | 15.0 |
| F-7 | 30.0 | 46.7 | 23.3 | — |
| F-8 | 30.0 | 46.7 | — | 23.3 |
| F-9 | 35.0 | 43.3 | — | 21.7 |

*1:1:1; NC(12.6N)/DANPE/NIBTN

The particular formulations set forth in Table I above have the following impetus and isochoric flame temperature, as set forth in Table II.

TABLE II

| | $I_m$ (ft-$lb_f/lb_m$) | $T_v$ (°K.) |
|---|---|---|
| F-1 | 497,100 | 3872 |
| F-2 | 485,600 | 3667 |
| F-3 | 499,400 | 3795 |
| F-4 | 499,700 | 3908 |
| F-5 | 500,300 | 3859 |
| F-6 | 500,700 | 3811 |
| F-7 | 494,500 | 3819 |
| F-8 | 496,300 | 3842 |
| F-9 | 492,300 | 3827 |
| F-10* | 466,700 | 4306 |

*Reference baseline consisting essentially of 75% RDX and 25% binder (33NC/67NG)

Obviously, numerous variations and modifications may be made without departing from the present invention. Accordingly, it should be clearly understood that the forms of the present invention described above are not intended to limit the scope of the present invention.

What is claimed is:

1. A propellant having a mass impetus above 485,000 ft-$lb_f/lb_m$, and an isochoric flame temperature below 4000° K., comprising a nitrocellulose-based binder matrix and an azide compound.

2. A propellant comprising a nitrocellulose-based binder matrix and a combination of azide compounds, which combination is selected from the group consisting of 1,6-diazido-2,5-dinitrazahexane; 1,7-diazido-2,4,6-trinitrazaheptane; and 1,9-diazido-2,4,6,8-tetranitrazanonane.

3. The propellant of claim 1, wherein said binder comprises nitrocellulose and 1,5-diazido-3-nitrazapentane.

4. The propellant of claim 1, wherein said binder comprises nitrocellulose 1,5-diazido-3-nitrazapentane, and nitroisobutylglycerol trinitrate.

5. The propellant of claim 1, wherein said binder matrix comprises in a 1:1:1 ratio, nitrocellulose, 1,5-diazido-3-nitrazapentane, and nitroisobutylglycerol trinitrate.

6. The propellant of claim 2, wherein said binder comprises nitrocellulose and 1,5-diazido-3-nitrazapentane.

7. The propellant of claim 2, wherein said binder comprises nitrocellulose, 1,5-diazido-3-nitrazapentane, and nitroisobutylglycerol trinitrate 8. The propellant of claim 2 wherein said binder matrix comprises in a 1:1:1 ratio, nitrocellulose, 1,5-diazido-3-nitrazapentane, and nitroisobutylglycerol trinitrate 9. The propellant of claim 1, wherein said binder matrix comprises from 25 percent to 35 percent of the propellant.

10. The propellant of claim 2, wherein said binder matrix comprises from 25 percent to 35 percent of the propellant.

* * * * *